US009033103B2

(12) United States Patent
Renton et al.

(10) Patent No.: US 9,033,103 B2
(45) Date of Patent: May 19, 2015

(54) SAFETY LINE TRAVELLER AND SUPPORT

(76) Inventors: Julian Renton, Bradford on Avon (GB); Peter Nott, Wingfield (GB)

( * ) Notice: Subject to any disclaimer, the term of this patent is extended or adjusted under 35 U.S.C. 154(b) by 0 days.

(21) Appl. No.: 13/117,662

(22) Filed: May 27, 2011

(65) Prior Publication Data

US 2011/0226549 A1 Sep. 22, 2011

Related U.S. Application Data

(63) Continuation of application No. 12/033,948, filed on Feb. 20, 2008, now Pat. No. 7,950,496, which is a continuation of application No. 10/477,261, filed as application No. PCT/GB02/02169 on May 10, 2002, now Pat. No. 7,347,300.

(30) Foreign Application Priority Data

May 11, 2001 (GB) ..... 011567.4
Jan. 30, 2002 (GB) ..... 0202175.6

(51) Int. Cl.
*A62B 35/00* (2006.01)

(52) U.S. Cl.
CPC ..... *A62B 35/0087* (2013.01); *A62B 35/0056* (2013.01)

(58) Field of Classification Search
USPC ..... 182/3, 36
See application file for complete search history.

(56) References Cited

U.S. PATENT DOCUMENTS

| | | | | |
|---|---|---|---|---|
| 4,790,410 | A | 12/1988 | Sharp et al. | |
| 5,279,385 | A | 1/1994 | Riches et al. | |
| 5,350,037 | A | 9/1994 | Ghahremani | |
| 5,979,599 | A | 11/1999 | Noles | |
| 6,474,442 | B1 | 11/2002 | Atkinson et al. | |
| 6,488,118 | B1 | 12/2002 | Corriveau | |
| 2001/0011721 | A1 * | 8/2001 | Pelofi et al. | 254/134.3 R |

FOREIGN PATENT DOCUMENTS

| | | |
|---|---|---|
| EP | 0273673 | 7/1988 |
| EP | 0608164 A1 | 7/1994 |

* cited by examiner

*Primary Examiner* — Alvin Chin-Shue
(74) *Attorney, Agent, or Firm* — Gordon & Jacobson, PC

(57) ABSTRACT

A traveller for a fall arrest system including a body having a bore and a slot narrower than the bore linking to the bore to the exterior of the body. A load member is connected to the body for pivotal movement relative to the body and suitable for attachment to fall safety equipment. The body has a center of gravity positioned so that when the traveller is supported on a safety line passing through the bore, the body will be urged by gravity to rotate about the safety line towards a position in which the slot has a predetermined orientation relative to the safety line.

23 Claims, 11 Drawing Sheets

SAFETY LINE TRAVELLER AND SUPPORT

CROSS-REFERENCE TO RELATED APPLICATIONS

This application is a continuation of U.S. application Ser. No. 12/033,948 filed Feb. 20, 2008, to be issued as U.S. Pat. No. 7,950,496, which is a continuation of U.S. application Ser. No. 10/477,261, now U.S. Pat. No. 7,347,300, which was filed Jun. 3, 2004 by Julian E. Renton and Peter Nott with the title SAFETY LINE TRAVELLER AND SUPPORT under 35 U.S.C. 371 from Patent Cooperation Treaty Application PCT/GB02/02169 which was filed on May 10, 2002 and claims priority under 35 U.S.C. 119 to United Kingdom application Serial No. GB0111567.4 filed May 11, 2001 and to United Kingdom application Serial No. 0202175.6 filed Jan. 30, 2002.

BACKGROUND OF THE INVENTION

1. Field of the Invention

This invention relates to a traveller and support for a safety line. The traveller can be used to secure fall safety equipment to a safety line which is supported by the supports and the traveller and supports cooperate to allow the traveller to move along the safety line and traverse the supports without the traveller being detached from the safety line.

2. Background Art

In order to protect personnel from falls when working at height it is usual, and often a legal requirement, to provide an elongate safety line or track running across or along the area in which the personnel are to work and to attach the personnel to the elongate safety line using a traveller able to slide along the line and connected to a safety harness worn by the personnel through a flexible lanyard.

The flexible lanyard allows the user freedom of movement to either side of the safety line and the traveller is pulled along the safety line by the lanyard to follow the user as they move along the safety line.

The safety line is anchored at each end. Further, in order to allow a long uninterrupted safety line and to allow the safety line to be guided around corners it is usually necessary for the safety line to also be mounted on a number of intermediate supports disposed along its length. Accordingly, the traveller and supports are arranged to cooperate so that the traveller can automatically pass along the safety line over the intermediate supports when pulled by the user with the lanyard without it being necessary to detach the traveller from the safety line.

A number of systems have been proposed in which this is carried out by the intermediate support including an arm section narrower than the safety line and the traveller being formed in a substantially C-shape broken by a slot, the slot being narrower than the safety line but wider than the arm of the intermediate support so that arm can pass through the slot to allow the traveller to traverse the intermediate support when pulled along the safety line but not allowing the traveller to become detached from the safety line.

A problem which has been encountered in systems of this type is ensuring that the slot in the traveller is properly aligned with the arm of the intermediate support in order to allow passage of the traveller over the intermediate support.

It has been proposed to overcome this problem in the past by using two parallel safety lines or a track having a non-circular cross-section so that a traveller engaged with both parallel safety lines or with the track respectively has its orientation controlled so that the slot and support are in alignment. However such an approach cannot be used in a traveller for use with a single safety line because a safety line has a substantially circular cross-section and so cannot be used to control the orientation of a traveller sliding along it.

It has also been proposed to control the alignment of a traveller on a single safety line so that the slot aligns with the safety line arm by using the load applied to the traveller by the safety lanyard to control the orientation of the traveller.

The problem with systems of this type is that in order for the traveller to be correctly rotationally aligned on the safety line so that the slot is aligned with the intermediate support arm the load applied by the safety lanyard to the traveller must be maintained within a small specified range of directions.

For example, where the safety line passes over the area in which users are to work above their head height the traveller and intermediate supports can be arranged so that the slot in the traveller is aligned with the intermediate support arm when the load applied to the traveller through the safety lanyard is vertically below, or in a small arc centered on the vertical below, the safety line. However, such a system suffers from the problem that it will not work if the user moves out of a narrow strip centered below the safety line because this will result in off vertical loads being applied through the lanyard as the user moves further away from the safety line. This will cause the traveller to rotate until the traveller slot and intermediate support arm no longer align. Accordingly, systems of this type are only suitable for use in situations where personnel movement is constrained to a narrow strip below the safety line, such as movement along catwalks, but are not suitable for situations where personnel can move freely about a large area.

Similar arrangements have also been proposed for use on roofs where the safety line is mounted a short distance above the roof surface on which the personnel can walk. Again, the usefulness of systems of this type is limited by the problem that the orientation of the load applied through the safety lanyard must be within a narrow range to maintain the alignment of the traveller slot with the intermediate safety arm. As a result, such systems are "handed" in that the user must always remain on the same side of the safety line and the distance which the user can move from the safety line is relatively small because if the user moves too far from the safety line the orientation of the force applied to the traveller by the safety lanyard cannot be reliably kept within an acceptable range for orientation of the arm and slot.

SUMMARY OF THE INVENTION

The present invention is intended to overcome these problems at least in part.

In a first aspect this invention provides a traveller for a fall arrest system comprising: a body having a bore and a slot narrower than the bore linking the bore to the exterior of the body, and a load member connected to the body for pivotal movement relative to the body and suitable for attachment to fall safety equipment, the body having a centre of gravity positioned so that when the traveller is supported on a safety line passing through the bore the body will be urged by gravity to rotate about the safety line towards a position in which the slot has a predetermined orientation relative to the safety line.

In a second aspect this invention provides a support for a safety line for a fall arrest system comprising a support section having a tube suitable for retaining a safety line and attachment means for attaching the support to a structure, the supporting section and attachment means being connected by an arm narrower than the tube, and further comprising a guide surface spaced apart from the arm and arranged so that when a safety line is retained in the tube and a traveller moves along the safety line towards the support the guide surface can cooperate with a guide member on a traveller to rotate the traveller about the safety line into a predetermined orientation relative to the arm.

In a third aspect this invention provides a fall arrest system comprising a safety line, at least one support and at least one traveller in which the support comprises a support section which retains the safety line and attachment means for attaching the support to a structure, the support section and attachment means being connected by an arm narrower than the safety line, the traveller comprises a body having a bore and a slot narrower than the bore linking the bore to the exterior of the body, the bore being larger than the safety line and the slot being narrower than the safety line but wider than the arm, and a load member connected to the body for pivotal movement relative to the body and suitable for attachment to fall safety equipment, the body having a centre of gravity positioned so that when the traveller is mounted on the safety line the body is urged by gravity to rotate about the safety line towards a position in which the slot is in line with the arm.

The traveller according to the invention, support according to the invention and fall arrest system according to the invention comprising the traveller and support allows the traveller to be automatically oriented with a support so that an arm of the support can pass through a slot in the traveller allowing the traveller to traverse the intermediate support when pulled along a safety line by a user lanyard but not allowing the traveller to become detached from the safety line regardless of the orientation of the force applied to the traveller by the lanyard.

As a result the system is not "handed", a user can move from one side of the safety line to the other without any problems and the user can move any desired distance from the safety line. Further, the lanyard connecting the user to the traveller can be as long as is desired without effecting the passage of the traveller over the support.

An example of a traveller and safety line support according to the invention is shown in the accompanying figures.

DETAILED DESCRIPTION OF THE PREFERRED EMBODIMENTS

Figure 1:
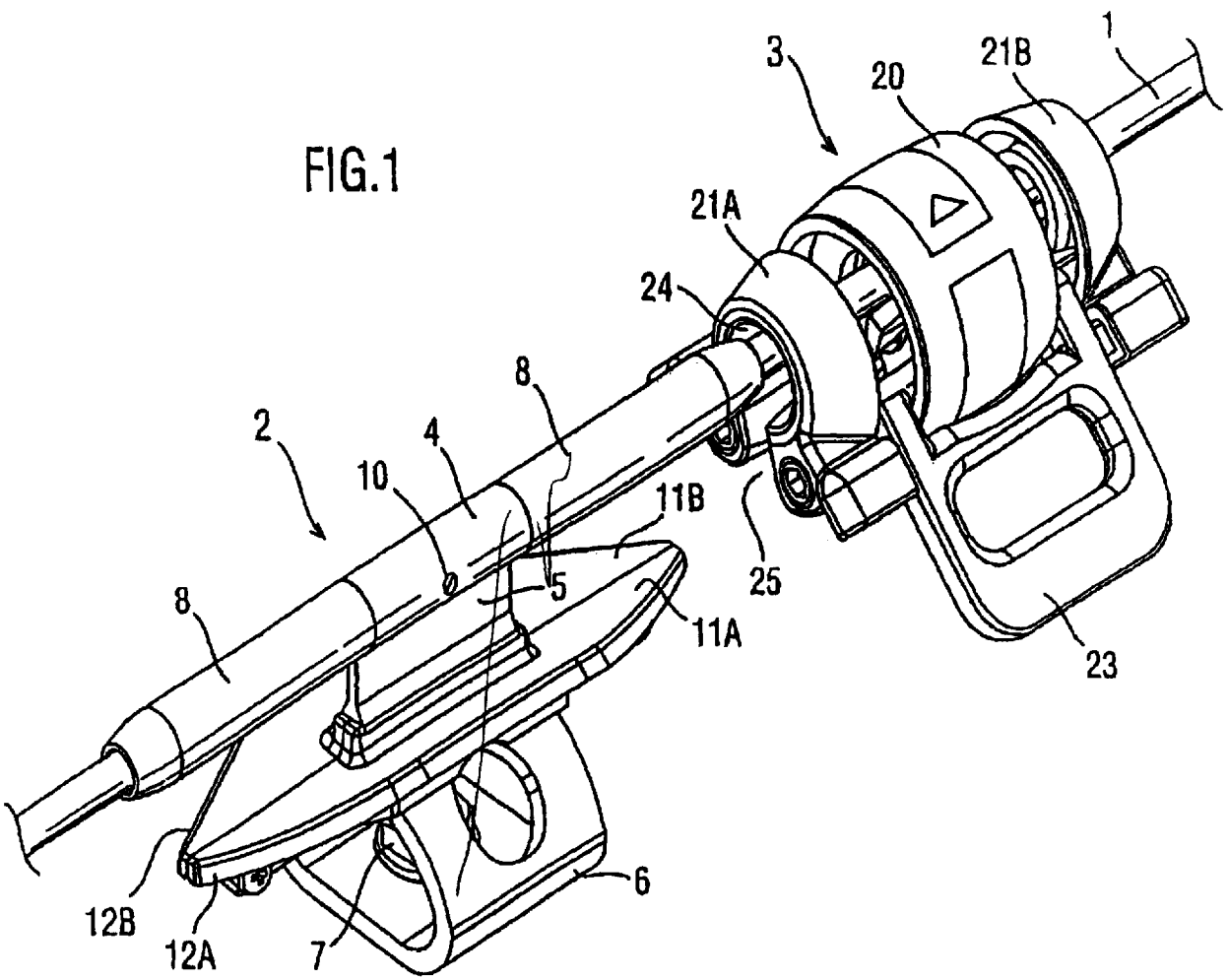
FIG. 1 shows a perspective view of a traveller according to the invention and a support according to the invention.
Figure 2:
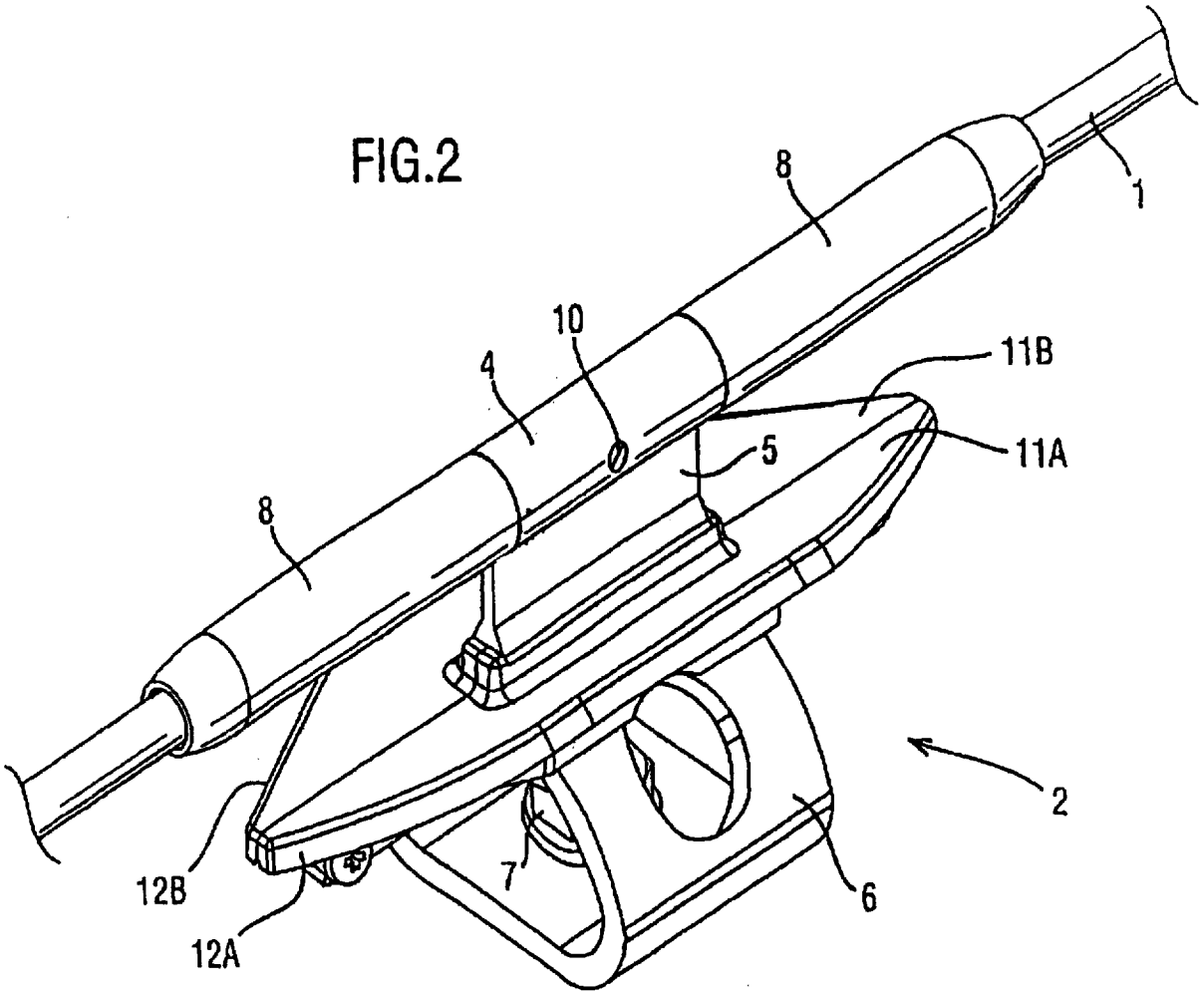
FIG. 2 shows an enlarged view of the support arm of FIG. 1.
Figure 3:
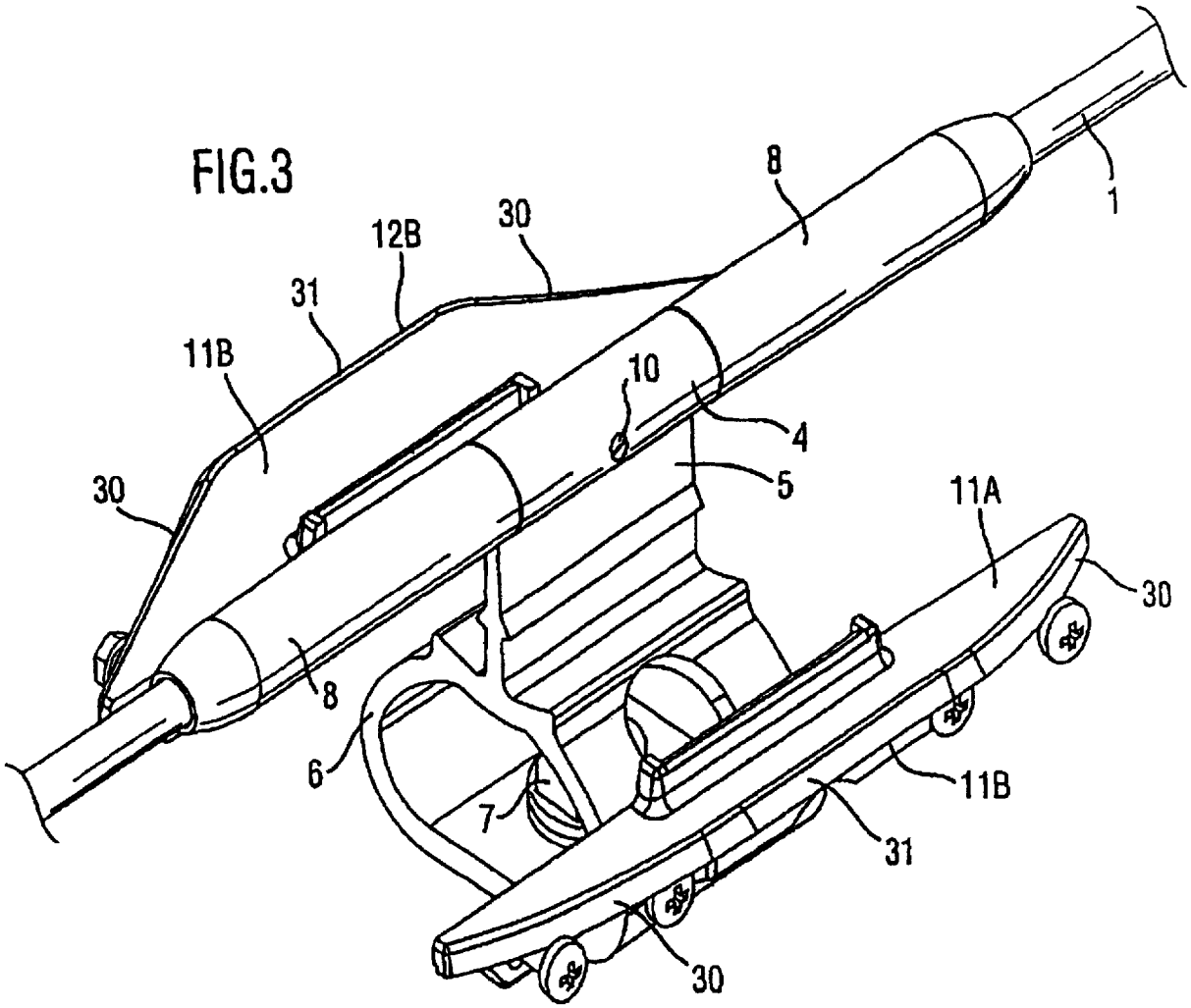
FIG. 3 shows a partially exploded view of the support of FIG. 1.
Figure 4:
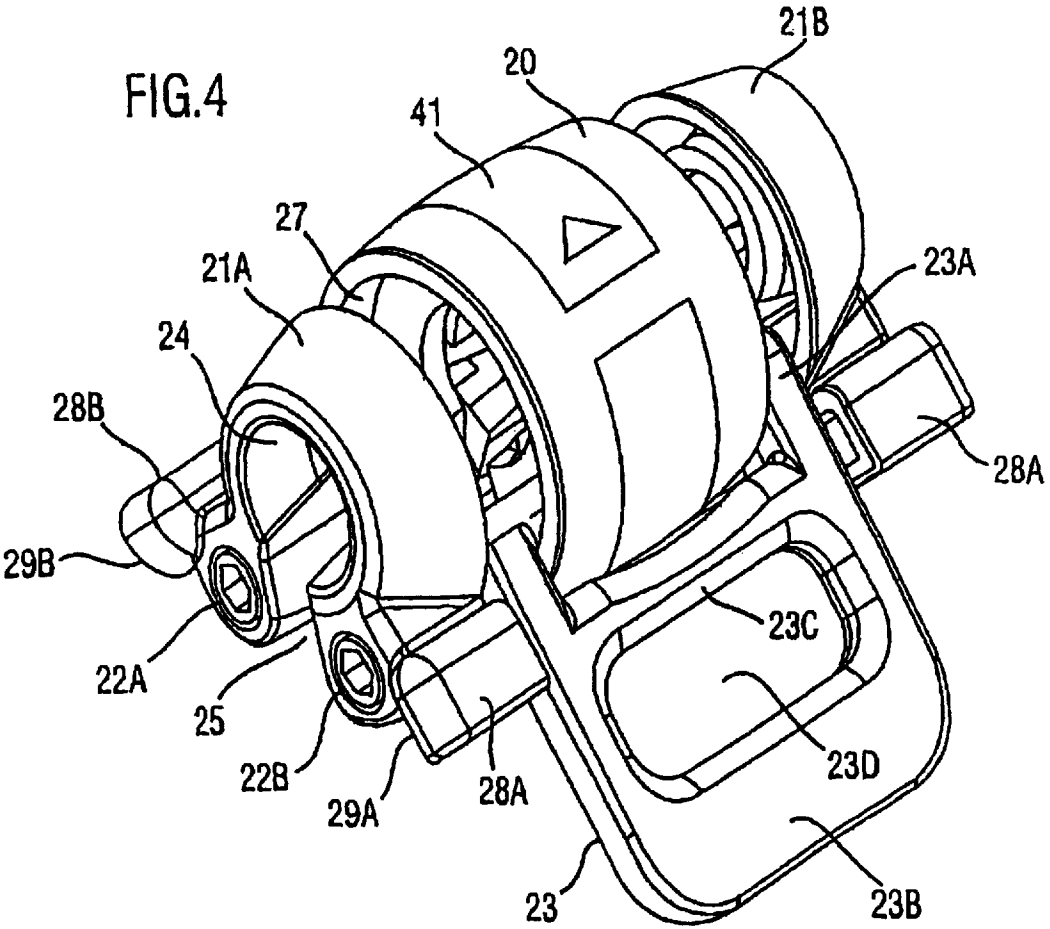
FIG. 4 shows an enlarged view of the traveller of FIG. 1.
Figure 5:
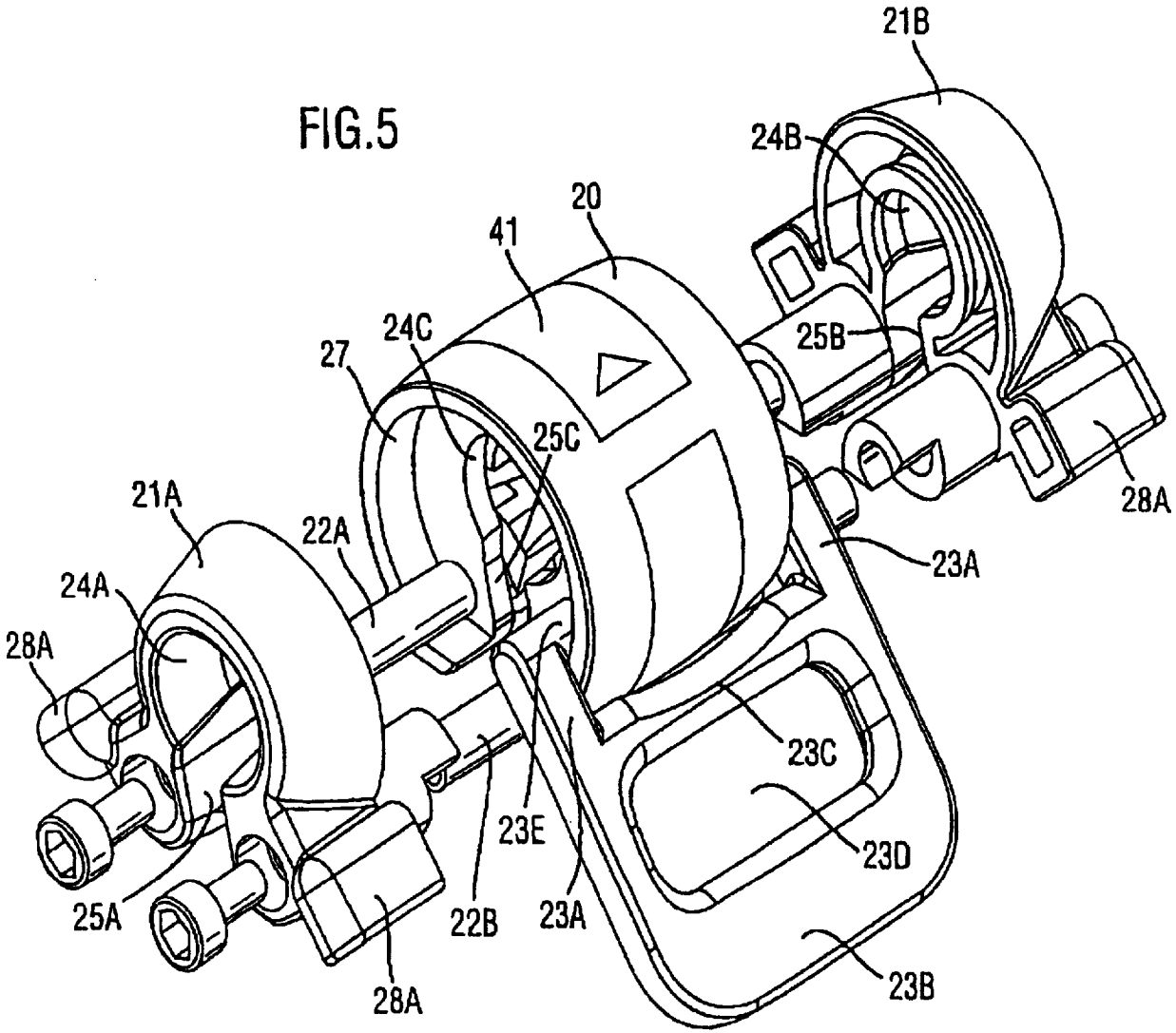
FIG. 5 shows a partially exploded view of the traveller of FIG. 1.

A continuous safety line 1 is supported by and passes through an intermediate support 2. A traveller 3 is mounted for sliding movement along the safety line 1.

The support 2 comprises a cable support section 4 formed as a hollow cylindrical tube through which the safety line 1 passes and an arm 5 connected to the support section 4 and having a width smaller than the diameter of the safety line 1. The arm 5 is connected to a spacer section 6 incorporating means for securing the support 2 to some fixed structure. Conveniently the securing means is a bolt hole for receiving a conventional bolt 7.

Conveniently, the spacer section 6 can be formed with a hollow closed cross-section so that the support section 4, arm 5 and spacer section 6 can be formed as a single extrusion. However, this is not essential and the shape and profile of the spacer section 6 can be varied as required to provide suitable spacing of the safety line 1 from the support structure and allow loads in a fall arrest situation to be safely transmitted between the safety line and support structure.

The support 2 also includes two elongate guide elements 8 formed by hollow tubes extending along the safety line 1 in each direction from the tubular support section 4. The elongate elements 8 have the same outer diameter as the tubular support section 4 and their ends remote from the tubular support section 4 are tapered inwardly towards the safety line.

The elongate guide elements 8 are secured to respective ends of the tubular support section 4 so that they are retained adjacent to the tubular section 4 and cannot move along the safely line 1 away from the tubular section 4 and preferably the elongate elements 8 are attached to the support section 4 so as to allow some pivotal movement so that the elongate elements 8 can pivot relative to the support section 4. This prevents the elongate elements 8 being subject to large bending loads when the safety line 1 is displaced away from the axis of the tubular support section 4. Such displacement will occur in a fall arrest situation. However, such sideways movement or loading of the safety line can also occur due to personnel leaning against or resting on the safety line 1 or using it as a handhold or due to wind loading or wind generated oscillation of the safety line 1.

Preferably, the safety line 1 is a stainless steel cable as is conventionally used in fall arrest systems while the support section 4, arm 5 and spacer section 6 of the support 2 are formed from an aluminum alloy extrusion. Accordingly, in order to prevent corrosion problems due to contact between dissimilar metals an insulating plastics sleeve 9 is provided inside the tubular support section 4 to electrically insulate the tubular support section 4 from the safety line 1.

The internal diameters of the extension elements 8 and the insulating sleeve 9 are all the same.

A screw 10 secures the insulating sleeve 9 within the support section 4. The screw 10 does not contact the safety line 1, which passes through the support 2 as a continuous unbroken length and is free to slide through the support 2.

The support 2 also comprises a pair of guide elements 11*a* and 11*b* which extend symmetrically from each side of the support 2. The outwardly projecting edges of the guide elements 11*a* and 11*b* form respective outwardly projecting guide surfaces 12*a* and 12*b*. The function of the guide surfaces 12*a* and 12*b* is discussed in detail below.

Preferably, the guide elements 11*a* and 11*b* are formed of plastics material and are secured together, for example by bolts, to locate the base of the arm 5 between them. Preferably the opposed surfaces of the arm 5, spacer section 6 and guide elements 11*a* and 11*b* have cooperating surface profiles to securely locate them relative to one another.

The traveller 3 comprises a body formed by a tubular centre 20 and two tubular ends 21*a* and 21*b* located at each end of and coaxial with the centre 20. The ends 21*a* and 21*b* are mirror images of one another so that the traveller 3 can travel along the safety line 1 and past the supports 2 in either direction. The centre 20 and ends 21*a* and 21*b* are secured together to form a single rigid structure by a pair of longitudinal parallel bars 22*a* and 22*b* passing through respective bores in the centre 20 and ends 21*a* and 21*b*.

A substantially D-shaped load handle 23 is attached to the centre 20. The load handle 23 is formed by a pair of parallel arms 23*a* linked by a pair of parallel connecting arms 23*b* and 23*c* to define a central aperture 23*d*. Lanyards or other connectors to personnel fall safety equipment are connected to the traveller 3 through the load handle 23. It is preferred that such attachment be through a carabineer or similar looped connector passing around an outer connecting arm 23*b* of the load handle 23 and through the aperture 23*a* of the load handle 23 for reasons which will be explained in detail below. However, the load handle 23 can be profiled, shaped or provided with attachment elements as required to be secured to whatever connectors are to be used.

The traveller 3 has a longitudinal circular bore 24 passing through it. The bore 24 has an outward flared section at each end. The bore 24 is made up of respective coaxial bores 24*a*, 24*b* and 24*c* in the ends 21*a* and 21*b* and centre 20 respectively and has a minimum internal diameter slightly greater than the external diameter of the support section 4 and elongate elements 8 of the support 2. The traveller 3 extends substantially around the bore 24 but is broken by a slot 25 extending longitudinally along the traveller 3 so that the traveller 3 is substantially C-shaped. The slot 25 has an outward flare at each end. Further, the slot 25 is slightly wider than the arm 5 of the support and is normally closed by a catch mechanism 26 so that the slot 25 is narrower than the diameter of the safety line 1. As a result, when the catch mechanism 26 is in the closed position the traveller 3 cannot be released from the safety line 1.

The catch mechanism 26 can be selectively moved into an open position in which the slot 25 is wider than the diameter of the safety line 1 to allow the traveller to be mounted onto or removed from the safety line 1. It should be noted that even when the catch 26 is in the open position the slot 25 is not wide enough to allow a traveller to be detached from the support 2 because this would require larger slot 25 and in general the narrower the slot 25 the stronger the traveller 3 will be.

The provision of a selectively openable catch mechanism 26 is not essential. However, if this it not provided it will not be possible to place the traveller 3 on and off the safety line 1 except at breaks in the safety line 1 where the traveller can be slid on and off the end of the safety line 1. Such an arrangement would in theory allow the traveller 3 to be made simpler and more secure because the slot 25 could be made with a single fixed width narrower than the diameter of the safety line 1. A traveller of this type could be used with suitable attachment and detachment stations being located at the ends of or at intermediate points along safety lines. Such attachment or detachment stations, sometimes known as gates, are well known in the art and need not be discussed in detail here. However, it is expected that in practice the greater convenience of a traveller 3 able to be attached and detached to the safety line 1 at any point along its length will outweigh the advantages of a simpler and stronger traveller only able to be attached and detached at dedicated stations. This is because in practice the requirement to go to a station to attach and detach the traveller from the safety line 1 will cause many users to risk their lives by not attaching themselves to the safety line 1 in order to avoid the inconvenience of having to find a station.

In the described embodiments having a three part structure of a centre 20 and ends 21*a* and 21*b* the slot 25 is formed by three slots 25*a*, 25*b* and 25*c* in line formed in the ends 21*a*, 21*b* and centre 20 respectively. The respectively openable catch 26 is provided to open and close the slot 25*c* in the centre 20 only and the slots 25*a* and 25*c* in the ends 21*a* and 21*b* have a profile corresponding to the shape of the slots 25*c* when the catch 26 is in the open position.

The centre 20 and ends 21*a* and 21*b* of the traveller 3 are substantially symmetrical about a vertical plane running through the centre of the slot 25 and through the axis of the bore 24. The bore 24 is located within the traveller 3 so that the centre of gravity of the body made up of the centre 20 and ends 21*a* and 21*b* is located such that when the traveller 3 is located on and supported by the safety line 1 the traveller 3 will rotate about the safety line and orient itself so that the slot 25 is vertically below the safety line 1.

In the illustrated embodiment the centre 20 and ends 21*a* and 21*b* have an external profile which is substantially circular about an axis which is offset from the axis of the bore 24 towards the slot 25 in order to ensure that the centre of gravity of the body comprising the centre 20 and ends 21*a* and 21*b* is well below the point of contact between the traveller 3 and safety line 1 so that there is a strong rotational moment acting on the traveller 3 which will rotate it about the safety line 1 into a position where the slot 25 is located vertically below the safety line 1.

The load handle 23 is attached to the centre 20 of the traveller 3 for pivotal movement around the traveller 3 through a large arc. The pair of parallel spaced apart arms 23*a* have extensions which pass around opposite ends of the centre 20 and have respective inwardly projecting pins 23*e*. The centre 20 has adjacent each of its ends an inwardly facing circular bearing surface 27 coaxial with the bore 24. The pins 23*e* projecting inside the centre 20 and bearing against the bearing surfaces 27 prevent the load handle 23 becoming detached from the rest of the traveller 3 but allow the load handle 23 to rotate relative to the rest of the traveller 3 through a large arc, in the described embodiment approximately 270° ranging from 45° below the horizontal and through the upward vertical to 45° below the opposite horizontal when the traveller 3 is hanging freely on the safety line 1 so that the slot 25 is vertically below the safety line 1.

The user of a D-shaped load handle 23 having two connecting arms 23*b* and 23*c* is preferred over a simple C-shaped handle because this arrangement reduces the risk of the parallel arms 23*a* splaying apart under load and releasing the pins 23*e* from the centre 20.

This arrangement allows the body of the traveller 3, that is the parts of the traveller 3 other than the load handle 23, to rotate under the influence of their own weight around the safety line 1 into a position where the slot 25 is substantially vertically below the safety line 1 independently of the direction of load applied through the load handle 23 in the attached safety lanyard throughout the large arc of movement of the load handle 23.

This is possible because the load handle 23 is able to rotate about the body of traveler 3 independently of the rotation of the body of the traveller 3 about the safety line 1.

Each of the ends 24*a* and 24*b* of the traveller 3 has a pair of spaced apart projecting cam elements 28*a*, 28*b*. The cam elements 28*a* and 28*b* project radially outwardly from the respective ends 21*a*, 21*b* and also project longitudinally beyond the end faces of the ends 21*a* and 21*b*. The cam elements 28*a* and 28*b* are located on each side of and equally spaced from the slot 25 and are 90° apart. Each cam element 28*a*, 28*b* defines a respective curved cam surface 29*a*, 29*b* extending substantially from the centre of the traveller 3 and facing around the circumference of the traveller 3 towards the slot 25 and longitudinally outwards from the end face of the respective end 21*a*, 21*b* of the traveller 3.

In use the traveller 3 is mounted on and supported by the safety line 1 which passes through the longitudinal bore 24. As explained above the offset of the centre of gravity of the main section of the traveller 3 from the point of contact between the safety line 1 and the inner surface of the bore 24 will cause the weight of the main section of the traveller 3 to generate a rotational couple which will tend to rotate the main section of the traveller 3 about the safety line 1 into an orientation where the slot 25 lies substantially vertically below the safety line 1.

As a user connected to the traveller 3 through a safety lanyard attached to the load handle 23 moves along the safety line 1 the traveller 3 is dragged by the lanyard along the safety line 1 to follow the user.

As explained above, during this movement the traveller 3 will automatically keep itself oriented so that the slot 25 is vertically below the safety line 1. When the traveller 3 reaches an intermediate support 2 one or both of the cam surfaces 29*a*, 29*b* of the cams 28*a*, 28*b* on the end 21*a*, 21*b* of the traveller 3 which is moving towards the support 2 will come into contact with a respective one or both of the guide surfaces 12*a* and 12*b* defined by the edges of the guide elements 11*a* and 11*b* of the support 2.

If the traveller 3 were perfectly oriented about the safety line 1 so that the slot 25 was exactly vertically below the safety line 1 the slot 25 would be in line with the arm 5 of the support 2 and the cam surfaces 29*a*, 29*b* would contact the respective guide surfaces 12*a* and 12*b* simultaneously.

In practice there will almost always be at least some rotational misalignment of the traveller 3 despite the tendency of the traveller 3 to orient itself with the slot 25 vertically below the safety line 1 so that one of the cam surfaces 29*a*, 29*b* will contact the respective guide surface 12*a* or 12*b* first. Once one of the cam surfaces 29*a*, 29*b* is in contact with one of the guide surfaces 12*a*, 12*b*, the movement of the cam surface 29*a* or 29*b* along the guide surface 12*a* or 12*b* as the traveller 3 moves further towards the support 2 rotates the body of the traveller 3 so that the slot 25 is moved into alignment with the arm 5. When the body of the traveller 3 is correctly oriented with the slot 25 in line with the arm 5 the second one of the cam surfaces 29*a*, 29*b* will also come into contact with its respective guide surface 12*a*, 12*b*, stopping rotation of the body.

The traveller 3 can then pass over the support 2 guided by the cam surfaces 29*a*, 29*b* in contact with the respective guide surfaces 12*a* and 12*b* so that the support section 4 and elongate element 8 pass through the bore 24 and the arm 5 passes through the slot 25.

In order to provide this guiding function effectively each guide surface 12*a*, 12*b* defined by the edges of the guide elements 11*a*, 11*b* comprises a leading section 30 at each end at an angle to the safety line 1 to engage a cam surface 29*a*, 29*b* and rotate the traveller 3 and a central straight section 31 running parallel to the safety line 1 which guides the cam surface 29*a*, 29*b* as the traveller 3 passes over the support 2 to keep the traveller correctly aligned.

It would be expected that the point at which both of the cam surfaces 29*a* and 29*b* contacted the respective guide surfaces 12*a* and 12*b* and the body of the traveller 3 was correctly aligned with the support 2 would be at the junction point between the leading section 30 and central section 31 of the respective guide surfaces 12*a*, 12*b*. However, in the described embodiment the central sections 31 are positioned such that the point at which both cam surfaces 29*a*, 29*b* contact the respective guide surfaces 12*a*, 12*b* is at points on the leading sections 30 of the guide surfaces 12*a*, 12*b* slightly before they merge into the central sections 31. As a result, after the traveller 3 is correctly aligned and both cam surfaces 29*a*, 29*b* are in contact with the respective guide surfaces 12*a*, 12*b* the further small outward extension of the leading surfaces 30 causes the traveller 3 to be lifted upwards off the safety line 1 until the bore 24 is coaxial with the safety line 1 and support section 4 and guide elements 8 of the support 2. This reduces the risk of the traveller 3 becoming jammed or locked in position as the end of the guide element 8 enters the aperture 24.

This further function of the cam surfaces 29*a*, 29*b* and guide surfaces 12*a*, 12*b* is optional and it may be preferred to have the lifting upwards of the traveller 3 from its normal position where the top of the bore 24 is resting on the safety line 1 to the bore 24 being substantially coaxial with the safety line 1 carried out by contact between the tapered or flared leading sections of the elongate elements 8 or bore 24. However, even where most of the lifting of the traveller 3 is carried out by these alternate means it is preferred to have the traveller 3 lifted by the cam surfaces 29*a*, 29*b* and guide surfaces 12*a*, 12*b* at least initially in order to prevent contact between the traveller 3 and the end of the elongate element 8 in order to avoid any risk of the traveller 3 jamming on contact with the end of the elongate element 8.

As explained above the cams 28*a*, 28*b* are spared apart by 90° so that they are spaced 45° either side of the slot 25 around the circumference of the traveller 3. Accordingly, provided that the orientation of the body of the traveller 3 is within 90° of the desired orientation where the slot 25 is vertically below the safety line 1 one of the cam surfaces 29*a*, 29*b* will contact one of the guide surfaces 12*a*, 12*b* and the traveller 3 will be able to successfully pass over the support 2. The arrangement of the centre of gravity of the body of the traveller 3 to cause the body of the traveller 3 to orient itself under the influence of gravity will reliably ensure that the orientation of the body of the traveller 3 is within this range.

Figure 9:
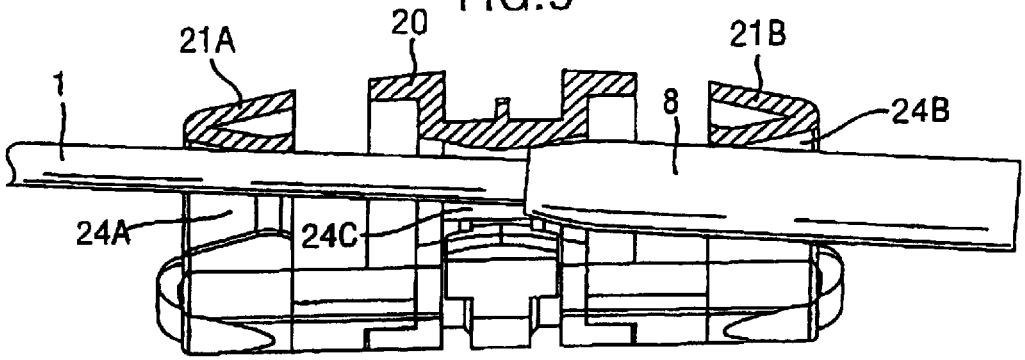
FIG. 9 shows the same view as FIG. 7 with the traveller partially mounted on the support.
Figure 10:
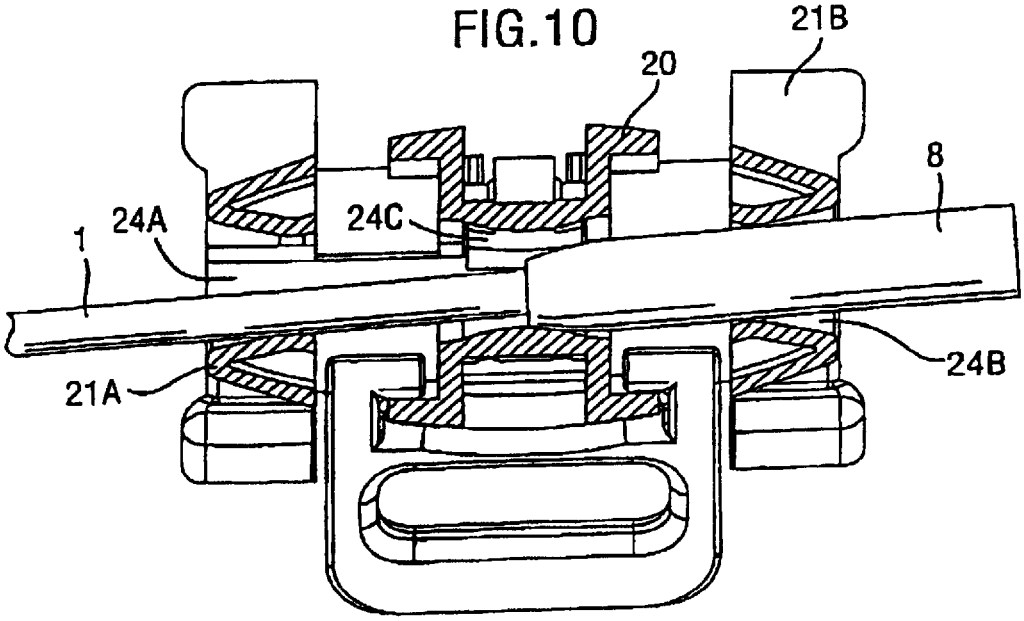
FIG. 10 shows the same view as FIG. 8 with the traveller partially mounted on the support.

The internal diameter of the bore 24 is larger than the external diameter of the safety line 1 so that the traveller 3 may approach the support 2 with the axis of the bore 24 at an angle to the safety line 1, as shown in FIGS. 9 and 10. This is likely to arise because the force applied by the safety lanyard to move the traveller 3 along the safety line 1 is applied through the load handle 23 so that the applied force is offset from the safety line 1 and the resulting couple will tend to rotate the traveller 3 about an axis perpendicular to the safety line 1. The amount of this misalignment is limited by the contact of the safety line 1 with the inner surface of the bore 24. Accordingly, this misalignment can be kept to a value which can be compensated for by the tapered ends of the elongate elements 8 and the entry flare on the ends of the bore 24. However, in order to avoid the possibility of the traveller 3 jamming due to this misalignment the internal surfaces of each of the coaxial bores 24*a*, 24*b* and 24*c* are each arranged to have a curved profile which is slightly tapered from a maximum diameter in each end to a minimum diameter in the centre.

The use of such a varying diameter internal profile helps to generate a couple on the traveller 3 when the support 2 enters the bore 24, this couple acting to bring the traveller into proper alignment.

The mounting of the carabineer or similar attachments to the safety lanyard so that it is free to slide along the D-shaped load handle 23 also helps to avoid jamming due to misalignment. This is because the attachment naturally tends to slide towards the front of the D-handle so that the point at which the load is applied is nearer to the front of the traveller 3 than the rear regardless of the direction which the traveller 3 is moving. Having the pulling point nearer to the front of the traveller 3 helps to reduce the risk of jamming due to misalignment.

Figure 6:
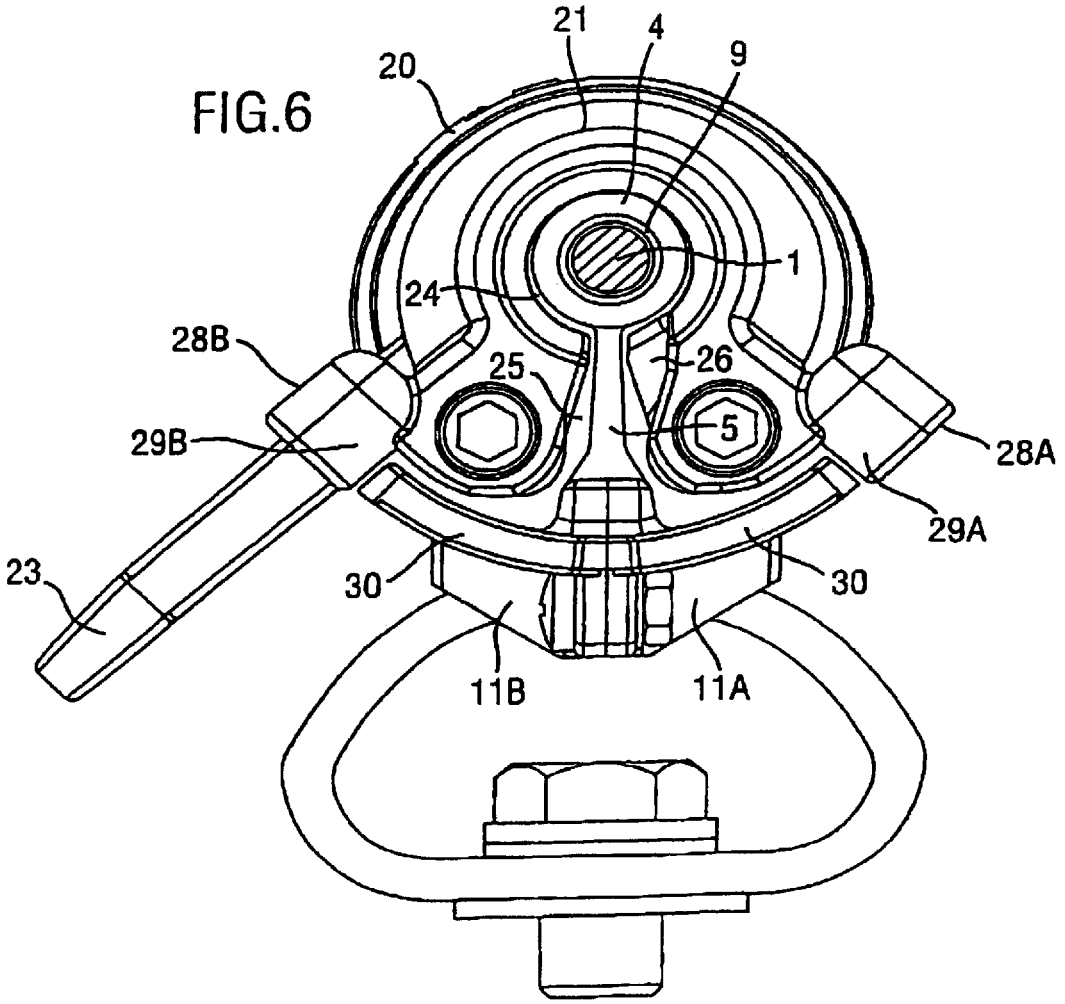
FIG. 6 shows an end view of the traveller of FIG. 1 passing over the support of FIG. 1.
Figure 7:
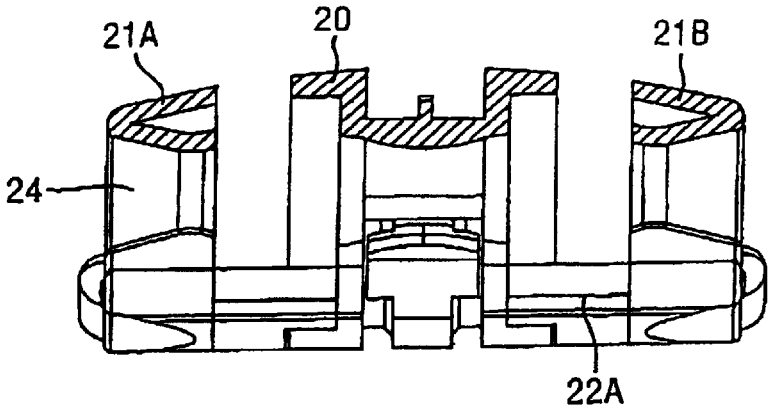
FIG. 7 shows a cut-away view of the traveller of FIG. 1 cut-away axially in a vertical plane.
Figure 8:
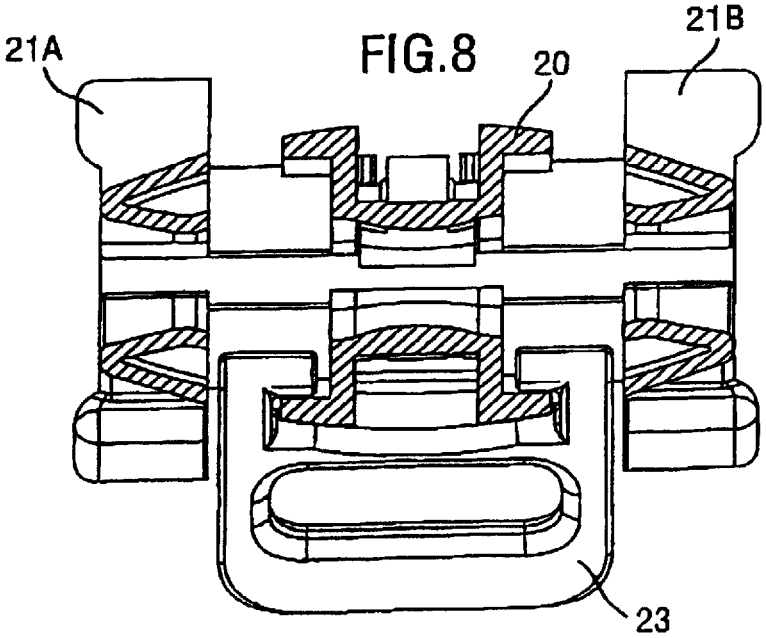
FIG. 8 shows a cut-away view of the traveller of FIG. 1 cut-away in the horizontal plane.

As explained above the circular bearing surfaces 27 in contact with the pins 23*e* of the load handle 23 are coaxial with the bore 24. As a result, when the traveller 3 is suspended on the safety line 1 the circular bearing surfaces 27 will not be coaxial with the safety line 1. In a fall arrest situation a large fall arrest load component perpendicular to the safety line 1 is applied through the load handle 23 and the offset between the axis of the circular bearing surfaces 27 and the safety line 1 will cause the body part of the traveller 3 to rotate relative to the handle 23 about the safety line 1 until the load handle 23 is at the end of its available are of movement relative to the body of the traveller 3. As a result, in a fall arrest situation the body of the traveller 3 will always rotate so that the safety line 1 is in contact with the side of the bore 24 at a position remote from the slot 25. This provides an additional margin of safety in operation because the weakest point of the traveller 3 is the slot 25. That is to say, the load which can be transmitted between the load handle 23 and safety line 1 will be a minimum when the geometry of the system is such that the load on the safety line 1 is directly in line with the slots 25 and this worst case geometry will not occur. In the preferred embodiment the cam elements 28*a*, 28*b* are arranged so that when the load handle 23 is at the limit of its pivotal movement around the body of the traveller 3 the load handle 23 is further from the slot 25 than the cam surfaces 29*a*, 29*b*. This ensures that when the traveller 3 is passing over the support 2 it is not possible for the load handle 23 to contact the support 2 and jam the traveller 3. This arrangement is best shown in FIG. 6.

The catch mechanism 26 is shown in FIGS. 11*a* to 11*d* which show cross-sections through the catch mechanism 26 in the centre 20 of traveller 3.

Figure 11A:
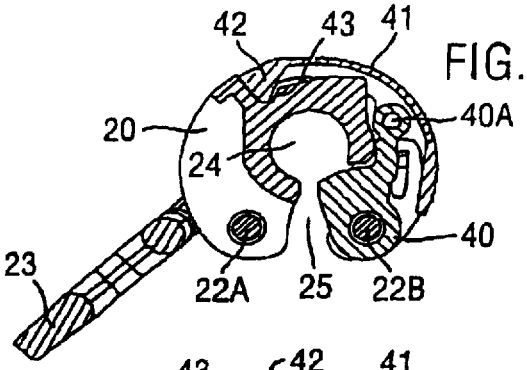
FIGS. 11*a* to 11*d* show the operation of a catch incorporated in the traveller of FIG. 1.

The catch 26 is normally in the closed and locked position shown in FIG. 11*a*.

Figure 11B:
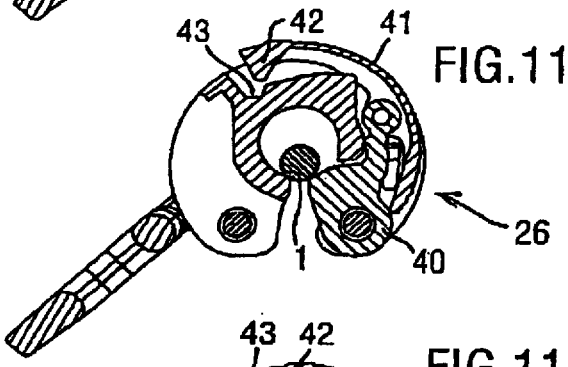
Figure 11C:
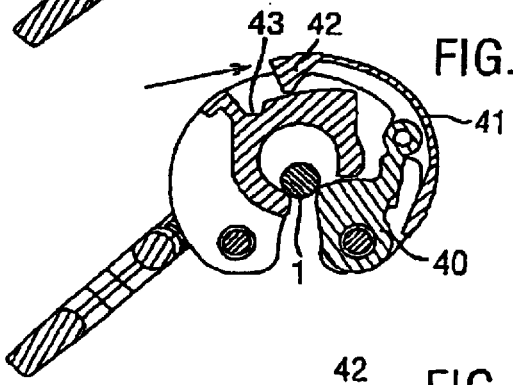
Figure 11D:
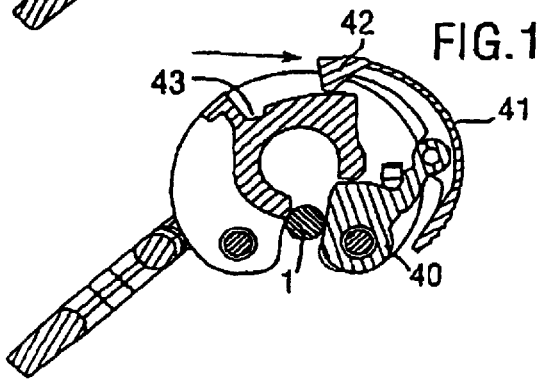

The catch 26 comprises a catch element 40 able to pivot between a first closed position shown in FIG. 11*a* and a second open position shown in FIG. 11*d* about one of the parallel bars 22*b*. The catch element 40 is biased into the closed position by a spring, not shown in the figures for clarity.

The catch element 40 is shaped so that the surface of the catch element 40 facing into the bore 24 is located between the bore 24 and the bar 22*b* about which the catch element 40 rotates. As a result, if it is attempted to force the safety line 1 out of the bore 24 through the slot 25 the forces applied to the catch element 40 will urge it closed rather than urge it open.

The catch element 40 is also pivotally connected by a pivot 40A to a handle element 41 forming a part of the outer surface of the traveller 3 and having an inwardly projecting tooth 42 engaged in a recess 43 in the centre 20 to lock the catch, as shown in FIG. 11*a*. The handle element 41 is biased by a spring to keep the tooth 42 in the recess 43, again the spring is not shown for clarity.

In order to open the catch mechanism 26 to allow the traveller 3 to be placed on or removed from the safety line 1 an end of the handle element 41 remote from the tooth 42 must be pushed inwards against the spring biasing to rotate the handle element 41 relative to the catch element 40 and disengage the tooth 42 from the recess 43 and unlock the catch as shown in FIG. 11*b*. Then, the handle element 41 must be moved, in the opposite direction to rotate the handle element 41 and catch element 40 around the bar 22*b*, again against spring biasing, and open the slot 25 as shown in FIG. 11*c*. Eventually this movement puts the catch element 40 into the second open position shown in FIG. 11*d* where the slot 25 is wide enough for the safety line 1 to pass through it. If at any point the handle element 41 is released the biasing will move the catch element 40 and handle element 41 back to the fully closed and locked position shown in FIG. 11*a*.

The requirement for two separate and sustained actions to be taken in order to open the catch mechanism 26 prevents accidental or inadvertent release of the traveller 3 from the safety line 1.

As has been explained above, the catch mechanism 26 is situated only in the centre 20 of the traveller 3 and the slots in the ends 21*a* and 21*b* will have the same profile as the open catch mechanism 26 shown in FIG. 11*b*.

In the described embodiment, in a fall arrest situation all of the loads are carried between the load handle 23 and safety line 1 through the centre 20 of the traveller 3 and not through the ends 21*a* and 21*b*. Further, it will be understood that most of the wear on the traveller 3 in use will take place on the ends 21*a*, 21*b*. As a result, the operating costs of the system can be minimised by making the ends 21*a*, 21*b* which do not have to carry fall arrest loads relatively cheaply and replacing them when worn out.

An alternative design of the catch mechanism which can be used to replace the mechanism 26 described above is shown in FIGS. 12*a* and 12*b*.

The alternative catch mechanism 60 is very similar to the catch mechanism 26 described above and same reference numerals are used for similar parts.

Figure 12A:
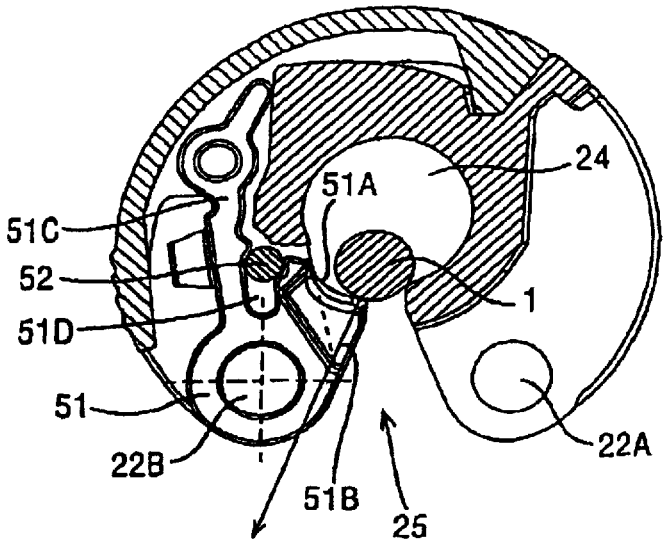
FIGS. 12*a* and 12*b* show a cut away view of an alternative traveller.

The catch mechanism 60 comprises a catch element 51 able to pivot between a first closed position shown in FIG. 12*a* and second open position, not shown, about one of the parallel bars 22*b* and biased into a closed position by a spring, similarly to the catch element 40 described above.

The catch element 51 is pivoted to a handle element 41 which is arranged and operates in a same manner as the handle element 41 described above to prevent accidental or inadvertent opening of the catch mechanism 60 and consequent release of the traveller 3 from the safety line 1.

The catch element 51 is shaped so that the surface of the catch element 51 facing into the bore 24 is located between the bore 24 and the bar 22*b* about which the catch element 51 rotates so that any load applied to the catch element 51 through the safety line 1 attempting to force safety line 1 out of the bore 24 through the slot 25 will tend to urge the catch element 51 closed rather than urge it open. Further, the surface of the catch element 51 facing into the bore 24 is formed with a part cylindrical concave surface 51*a* facing into the bore 24, the concave surface 51*a* being formed about an axis of rotation parallel to the axis of the bore 24 and having a radius similar to or slightly greater than the radius of the safety line 1. The profile and material of the catch element 51 are selected so that if a load above the predetermined threshold is applied to the catch element 51 by the safety line 1, for example in the direction of the arrow A in FIG. 12*a*, the catch element 51 will yield slightly so that the catch element 51 yields in a direction which tends to close up the slot 25.

Figure 12B:
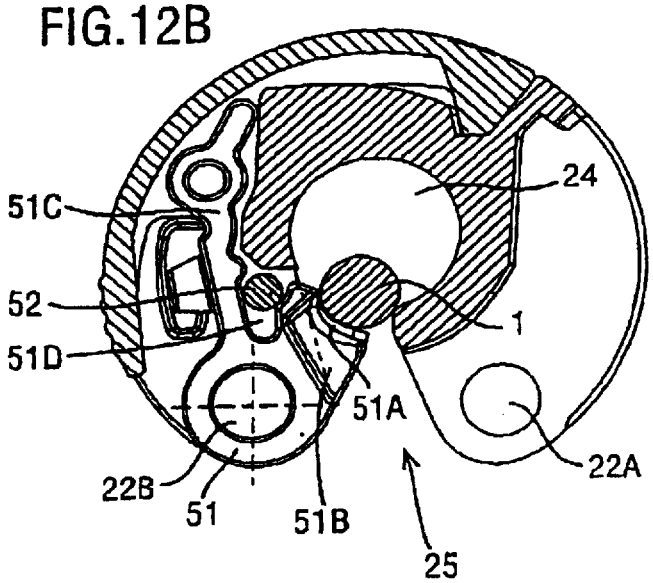

FIG. 12*b* shows the alternative catch element 51 after a fall arrest has occurred loading the safety line 1 against the catch element 51 towards the slot 25. As can be seen by comparison between the FIGS. 12*a* and 12*b* the yielding of the catch element 51 is such that the part of the catch element 51 extending into the slot 25 moves further into the slot 25, so making slot 25 narrower.

In practice the load at which yielding or plastic deformation of the catch element 51 begins should be low enough that the loads generated by a fall arrest event in which the safety line 1 is urged towards the slot 25 will cause yielding of the catch element 51 to take place and high enough so that the yielding of catch element 51 will not occur during normal usage and handling of the traveller 3.

The use of a yielding catch element 51 allows the gap formed by the slot 25 to close up in the unlikely event that the fall arrest loads on the safety line 1 are in line with the slot 25.

One theoretically possible problem is that if that the safety line 1 were loaded towards the slot 25 and there was relative rotation between the safety line 1 and the traveller 3, in theory this relative rotation could allow the safety line 2 to force open the catch element 40 or 51. However, it is very difficult to envisage a practical situation in which this could actually occur.

If such forcing open of the catch element 40 or 51 is regarded as a problem, this can be prevented by use of a yielding catch element 51. This is because the yielding of the catch element 51 under a large load causes a part of the catch element 51 closing the slot 25 to move further into the slot 25 and so narrows the gap. This yielding of the catch element 51 to close up the gap will increase the amount of the movement of the catch element 51 required to allow the safety line 1 to pass through the slot 25, so reducing the chance of sufficient movement of the catch element 51 to release the safety line 1 occurring.

Further, as explained above, the face of the catch element 51 facing the bore 24 has a part cylindrical concave surface or cavity 51*a* having a radius substantially equal to or slightly greater than the radius of the safely line 1. This part cylindrical concave surface 51*a* is arranged and positioned so that as yielding of the catch element 51 takes place due to the safety line 1 being urged through the slot 25, the concave surface 51*a* will move into a position where it will form a radial surface on which the safety line 1 can rest, as shown in FIG. 12*b*. Even if rotation of safety line 1 relative to the traveller 3 occurs, the safety line 1 will simply rotate against this radial surface 51*a* which will not provide any edges or protuberances for the safety line 1 to catch on. This will reduce the likelihood of a safety line 1 rotating relative to the traveller 3 gaining sufficient purchase on the catch element 51 to force it open.

The catch element 51 in the described alternative embodiment has two arms 51*b* and 51*c* separated by a gap 51*d*. The face 51*a* is arranged to face into bore 24 at one end of the arm 51*b*. A back stop 52 formed by a rod is located in slot 51*d* between the arms 51*b* and 51*c* so that the back stop 52 prevents the slot 51*d* being closed so that the arms 51*b* and 51*c* move closer together but allows the slot 51*d* to be opened so that the arms 51*b* and 51*c* move further apart. As can be seen in FIG. 12*b* the catch element 51 is arranged so that the opening up of the slot 51*d* and increasing separation of the arms 51*b* and 51*c*, which is allowed by the backstop 52, will cause the catch element 51 to close up the slot 25. Similarly, the closing of the slot 51*d* and moving together of the arms 51*b* and 51*c*, which is prevented by the backstop 52, would tend to open slot 25. Thus, the catch element 51 can yield as described above in response to a fall arrest load applied through the safety line 1 in order to close up the slot 25 but a similar load applied, to the exterior surfaces of the catch element 51 will not cause yielding the catch element 51 in a direction tending to open out the slot 25 because of the presence of the backstop 52.

This prevents the user forcing a tool such as a screw driver into the slot 25 and bending the yielding catch element 51 to increase the size of the slot. Although such vandalism is clearly unwise, it is possible that a user might attempt to bend the yielding in catch element 51 so that the slot 25 is wide enough to allow the traveller 3 to be lifted on and off the safety line 1 at will in order to avoid the effort of using the release mechanism. It should be noted that where a non-yielding catch element 40 is used, the catch element should be strong enough to resist such a casual attack with hand tools.

In most fall safety systems the safety line 1 will be made of stainless steel. Where the traveller 3 is to be used with a safety line 1 of stainless steel, it is preferred to form the catch element 40 or 51 from aluminum bronze. There is a relatively low coefficient of friction between aluminum bronze and stainless steel, so that the use of an aluminum bronze catch element will reduce any perceived risk of rotation of the safety line 1 and the traveller 3 forcing the catch element open because of the reduced friction between the safety line 1 and the catch element.

Further, in a situation where the traveller 3 slides on the safety line 1 during a fall arrest event, the use of a material such as aluminum bronze or a material having similar properties greatly reduces or eliminates galling of the surface of the stainless steel wire by the catch element. Reducing or eliminating such galling avoids compromising the strength of the safety line 1 in the critical moments immediately after a fall arrest event.

Such galling is usually only a problem if the safety line is forced into the catch element 40 or 51 in a fall arrest situation because when the safety line 1 is forced against another part of the interior of the bore 24 the fall arrest loads are spread over a much larger area of the surface of the safety line 1.

Although the tendency of the catch element to yield is a function of both the catch element shape and the material used, it is believed that aluminum bronze or a similar material is suitable for forming both yielding and non-yielding catch elements by selection of a suitable catch element shape.

The catch mechanism 26 described above with reference to FIG. 11 and also used in the alternative embodiment of FIG. 22 is highly resistant to inadvertent opening of the catch element 40 or 51 whether due to rotation of safety line 1 relative to the traveller 3 or another cause. The catch element 40 or 51 is spring biased closed and is pivotally engaged to a handle 41 having a tooth 42 engaged in a recess 43. The handle 41 is separately spring biased to retain the tooth 42 in the recess 43. The tooth 42 and recess 43 are shaped so that loads applied to the handle 41 through the catch element 40 or 51 will simply urge the contact surfaces of the tooth 42 and recess 43 together and will not tend to urge the tooth 42 out of the recess 43.

As a result, in order to open the catch element 40 or 51 by accident a load must be applied to the catch element 40 or 51 which is sufficiently large to not only overcome the spring biasing but also to break or deform the catch element 40 or 51, the handle 41 or the connection between them. Otherwise, the engagement of the tooth 42 and the recess 43 will prevent movement of the catch element 40 or 51.

As described above, the catch mechanism 26 requires two separate and sustained actions to be taken in order to open the catch mechanism 26 and release the traveller 3 from the safety line 1. This involves two separate and sustained actions and will normally be sufficient to prevent an inadvertent release of the safety line 1 and will satisfy current safety legislation.

Figure 13A:
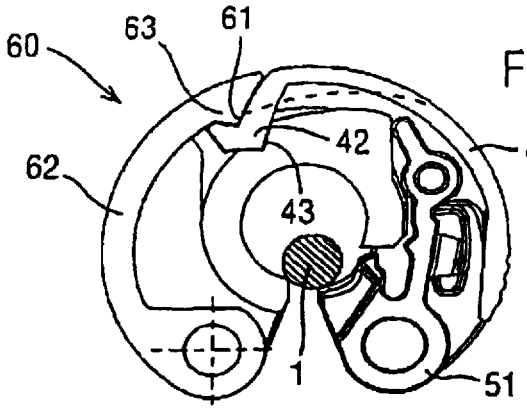
FIGS. 13*a* to 13*c* show the operation of an alternative catch.
Figure 13B:
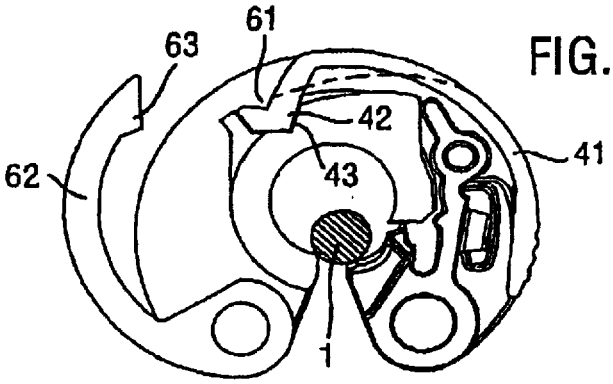
Figure 13C:
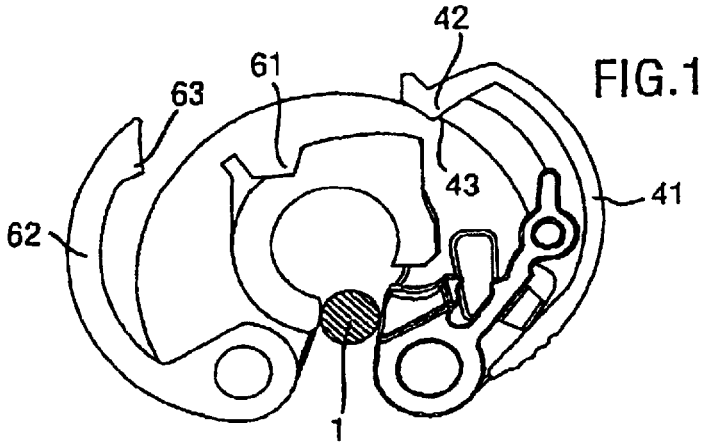

An alternative catch mechanism 60 is shown in FIGS. 13*a* to 13*c*. The alternative catch 60 involves a catch element 51 pivotally connected to a handle element 41 having an inwardly projecting tooth 42 engaging with a recess 43 in the centre 20 to lock the catch 60, similarly to the catch 26 described above.

The handle 41 of the alternative catch 60 has a recess 61 on its exterior in addition to the inwardly projecting tooth 42. The alternative catch element 60 also includes a second handle 62 forming a part of the outer surface of the traveller 3 and having an inwardly projecting tooth 63 engaged in the recess 62 in the handle 41 to lock the catch 60, as shown in FIG. 13*a*. The second handle 62 is biased by a spring to keep the tooth 63 in the recess 61. The spring is not shown for clarity.

In order to open the alternative catch mechanism 60 and allow the traveller 3 to be placed on or removed from a safety line 1, the second handle 62 must be pulled outwards against the spring bias in order to rotate the second handle 62 relative to traveller 3 and disengage the tooth 63 from the recess 61, as shown in FIG. 13*b*.

The handle 41 must then be manipulated as described above with reference to FIG. 11*a* to FIG. 11*d* in order to rotate the catch element 51 round the bar 22*b* into the second open position shown in FIG. 13*c* so that the slot 25 is opened wide enough for safety line 1 to pass through it.

If, at any point, the handle 41 is released the spring bias will move the catch element 51 and handle 41 back to the closed and locked position shown in FIG. 13*b*. If the second handle element 62 is also released the spring bias will move the catch mechanism 60 back to the fully closed and locked position shown in FIG. 13*a*. The geometry and movements of the contacting surfaces of the handle 41 and second handle 62 are such that the two handle elements 40 and 62 will automatically move back into the fully closed and locked position as shown in FIG. 13*a* regardless of the order in which the handle elements 41 and 62 are released.

The alternative catch 60 requires three separate and sustained actions to be taken in order to open the catch element 51, providing further assurance against accidental or inadvertent release of the traveller 3 from the safety line 1.

FIG. 13 show the alternative catch mechanism 60 used together with the yielding catch element 51. The alternative catch mechanism 60 could also be used with a non-yielding catch element 40.

Another alternative embodiment of the invention would be to replace the cams 28 with wheels mounted for rotation about respective axes extending approximately radially from the axis of the bore 24. The circumferential surfaces of these wheels would replace the cam surfaces 29*a* and guide the traveller 3 by rolling along the guide surfaces 12*a* and 12*b* as tracks. This arrangement using guide wheels would minimise the frictional resistance of the traveller 3 to passing over the support 2 and can be most advantageously applied in a system where the guide wheels and guide surfaces 12*a* and 12*b* cooperate to lift the traveller 3 so that the only contact between the traveller 3 and support 2 is through the guide wheels.

It will be realised that the precise shape and location of the cams 28, guide wheels and guide surfaces 12 may be varied. For example, it is not essential that the cams 28 project beyond from the front faces of the ends 21*a* and 21*b* of the traveller 3. However, the cam surfaces 29 or wheels must contact the guide surfaces 12 and bring the traveller 3 into alignment with the support 2 before the arm 5 contacts the traveller 3.

The use of separate elongate elements 8 as part of the support 2 is not essential and this could be replaced by giving the support section 4 tapered ends. Whether or not the elongate elements 8 are required will depend upon the materials used for the arm 2 and the difference in external diameter between the safety line 1 and support section 4.

In one example of the invention the safety line 1 is a stainless steel cable having an external diameter of 8 mm and the external diameter of the tubular section 4 is 16 mm.

The traveller 3 according to the invention is self orienting about the safety line 1 to bring it roughly into the required orientation to traverse the support 2 and the cams or wheels on the traveller 3 cooperate with the guide surfaces 12 on the support 2 to adjust the orientation of the traveller 3 to be precisely aligned to allow the support to be traversed.

This system provides the advantage that where the safety line 1 is mounted on the supports 2 on a surface on which personnel work the system is not "handed" so that a user can move on either side of the safety line 1 and cross over from one side of the safety line 1 to the other freely. Further, because the orientation of the traveller 3 is not controlled by the forces applied along the safety lanyard the safety lanyard can be as long as desired because there is no need to control the orientation of the forces applied to the traveller 3 by a safety lanyard. As a result, users can move wherever they wish through a very large area around the safety line 1 without effecting the smooth and automatic movement of the traveller 3 along the safety line 1 and over the support 2 as dragged by the lanyard to follow the users movements.

It will be appreciated that such automatic smooth and reliable traversing of supports by the traveller even the end of a long lanyard is very important in practice because the reaction of many users to a traveller which regularly hung up or jammed on supports and required the user to take some action to un-jam the traveller and move it over the supports will be to simply disconnect themselves from the traveller and work without any fall protection.

The invention is discussed in terms of its use in a personnel fall safety system in which a user is attached to the traveller by a safety lanyard. This is the most important application in the invention but it will be understood that other items could be attached to the traveller on a lanyard such as items of equipment.

In the desired embodiment of the invention the safety line 1 passes through the supports 2 but it is not attached to them so that the safety line 1 can be freely pulled through the supports 2. This arrangement is common in fall arrest systems in order to allow fall energy to be transmitted along the safety line 1 from the traveller 3 through one or more intermediate supports to an end anchor and energy absorber at the end of the safety line 1 which absorbs the fall energy. However, alternative systems in which the safety line is rigidly attached to the supports and the fall energy is absorbed by energy absorbers incorporated into the intermediate supports or in which controlled movement of the safety line through the intermediate supports is allowed so that some of the fall energy is absorbed by each intermediate support are also known. The present invention is suitable for use with all of these systems provided that suitable known means for preventing or controlling movement of the safety line through the intermediate support 2 is added.

In the described embodiments the traveller body is arranged to be biased automatically into an orientation where the slot 24 is vertically below the safety line 1 and the arm 5 of the support 2 is also arranged vertically below the safety line 1. This is the most advantageous arrangement and is particularly convenient when the safety line 1 is mounted through the supports 2 on the surface on which the users of the system will walk. However, in principle the arm 5 could be at any orientation to the safety line 1 and the present invention could be used to orient the body of the traveller 3 accordingly by suitable location of the centre of gravity of the body and the cams, wheels and guide surfaces.

The embodiments described are preferred embodiments of the invention only and the person skilled in the art would be able to envisage alterations which can be made while remaining within the scope of the invention.

What is claimed is:

1. A traveller for a fall arrest system employing fall safety equipment as well a safety line retained by a support, the traveller comprising:

a unitary rigid body structure and a load member pivotally connected to the unitary rigid body structure for pivotal movement relative to the unitary rigid body structure and suitable for attachment to the fall safety equipment, wherein the unitary rigid body structure is separate from the load member;

wherein the unitary rigid body structure defines a bore and an open slot narrower than the bore, wherein the bore is configured to allow the safety line to pass through the bore and allow movement of the traveller along the safety line, and wherein the bore has a central axis and wherein the open slot extends radially from the bore in a direction transverse to the central axis of the bore and extends laterally along the length of the bore in a unitary direction parallel to the central axis of the bore between opposed ends of the unitary rigid body structure, wherein the unitary rigid body structure includes first and second pairs of guide members, wherein the first pair of guide members is offset radially from opposed sides of the slot at one end of the unitary rigid body structure and the second pair of guide members is offset radially from opposed sides of the slot at the other end of the unitary rigid body structure, and wherein each guide member of the first and second pairs of guide members has a thickness along a radial direction transverse to the central axis of the bore that is greater than thickness of a corresponding portion of the unitary body structure that is diametrically opposed to such guide member; and wherein the unitary rigid body structure has a center of gravity positioned below point of contact between the traveller and the safety line so that when the traveller is supported on the safety line passing through the bore the unitary rigid body structure will be urged by gravity to rotate about the safety line towards a position in which the entire open slot of the unitary rigid body structure is disposed vertically under the safety line, and the first and second pairs of guide members are configured to interface to at least one of two guide surfaces of the support during movement of the traveller past the support in order to compensate for rotational misalignment of the traveler relative to the support.

2. A traveller according to claim 1, in which the load member is connected to the unitary rigid body structure for rotational movement relative to the unitary rigid body structure through an arc around the bore.

3. A traveller according to claim 1, in which the load member is connected to the unitary rigid body structure so that when the traveller is supported on the safety line passing through the bore the load member and the unitary rigid body structure can rotate independently about the safety line.

4. A traveller according to claim 1, in which the load member is connected to the unitary rigid body structure so that when the traveller is supported on the safety line passing through the bore the unitary rigid body structure will be urged by gravity to rotate about the safety line towards said position independently of the rotational position of the load member when the load member is within a predetermined range of rotational positions relative to the unitary rigid body structure.

5. A traveller according to claim 1, in which the unitary rigid body structure comprises a number of parts that are secured together to form a single rigid structure.

6. A fall arrest system comprising:

at least one support that is configured to support a safety line in a stationary configuration, wherein the support includes two guide surfaces that are offset from said safety line below said safety line; and a traveller comprising a unitary rigid body structure and a load member pivotally connected to the unitary rigid body structure for pivotal movement relative to the unitary rigid body structure and suitable for attachment to the fall safety equipment, wherein the unitary rigid body structure is separate from the load member;

wherein the unitary rigid body structure of the traveller defines a bore and an open slot narrower than the bore, wherein the bore is configured to allow the safety line to pass through the bore and allow movement of the traveller along the safety line, and wherein the bore has a central axis and wherein the open slot extends radially from the bore in a direction transverse to the central axis of the bore and extends laterally along the length of the bore in a unitary direction parallel to the central axis of the bore between opposed ends of the unitary rigid body structure, wherein the unitary rigid body structure includes first and second pairs of guide members, wherein the first pair of guide members is offset radially from opposed sides of the slot at one end of the unitary rigid body structure and the second pair of guide members is offset radially from opposed sides of the slot at the other end of the unitary rigid body structure, and wherein each guide member of the first and second pairs of guide members has a thickness along a radial direction transverse to the central axis of the bore that is greater than thickness of a corresponding portion of the unitary body structure that is diametrically opposed to such guide member; and wherein the unitary rigid body structure of the traveller has a center of gravity positioned below point of contact between the traveller and the safety line so that when the traveller is supported on the safety line passing through the bore the unitary rigid body structure will be urged by gravity to rotate about the safety line towards a position in which the entire open slot of the unitary rigid body structure is disposed vertically under the safety line, and the first and second pairs of guide members are configured to interface to at least one of the two guide surfaces of the support during movement of the traveller past the support in order to compensate for rotational misalignment of the traveler relative to the support.

7. A fall arrest system comprising:

a safety line;

at least one support having a support section which retains the safety line and attachment means for attaching the support to a structure, the support section and attachment means being connected by an arm narrower than the safety line, wherein the arm extends upward in a vertical direction from the support section, and wherein the support has two guide surfaces spaced from the arm;

a traveller according to claim 1, wherein said position of the open slot in which the entire open slot of the unitary rigid body structure is disposed vertically under the safety line is in line with the arm.

8. A system according to claim 7, in which the load member is connected to the unitary rigid body structure for rotational movement relative to the unitary rigid body structure through an arc around the bore.

9. A system according to claim 7, in which the load member is connected to the unitary rigid body structure so that when the traveller is mounted on the safety line the load member and the unitary rigid body structure can rotate independently about the safety line.

10. A system according to claim 7, in which the load member is connected to the unitary rigid body structure so that when the traveller is mounted on the safety line the unitary rigid body structure will be urged by gravity to rotate about the safety line towards said position independently of the rotational position of the load member when the load member is within a predetermined range of rotational positions.

11. A system according to claim 7, in which the first and second pairs of guide members of the traveller cooperate with the two guide surfaces of the support to rotate the unitary rigid body structure relative to safety line in different rotational directions.

12. A system according to claim 7, in which the unitary rigid body structure supports a catch able to selectively move between a closed position in which a safety line cannot pass through the slot and an open position in which a safety line cannot pass through the slot.

13. A system according to claim 12, in which, when the catch is in the closed position the slot is narrower than the safety line but wider than the arm and when the catch is in the open position the slot is wider than the safety line.

14. A system according to claim 12, in which the catch is arranged to deform in response to an applied load above a threshold value and in a direction away from the bore and along the slot, the deformation causing the catch to narrow the slot.

15. A system according to claim 7 in which the first and second pairs of guide members of the traveller are defined by cam elements that are part of opposed ends of the unitary rigid body structure.

16. A system according to claim 7 in which the first and second pairs of guide members of the traveller are defined by wheels.

17. A system according to claim 7 in which the bore is circular in section and the load member is connected to the unitary rigid body structure for pivotal movement about the axis of the bore.

18. A system according to claim 7 in which the first and second pairs of guide members of the traveller cooperate with the two guide surfaces of the support to lift the unitary body structure upwards from the safety line.

19. A system according to claim 18 in which the first and second pairs of guide members of the traveller guide members cooperate with the two guide surfaces to lift the unitary body structure upwards until the bore is aligned with the support section of the support.

20. A system according to claim 7, in which the support section comprises a tube suitable for retaining the safety line.

21. A traveler according to claim 1, in which the center of gravity of the unitary rigid body structure is configured to cause the unitary rigid body structure to automatically rotate about the safety line under the influence of gravity towards the position in which the entire open slot of the unitary rigid body structure is disposed vertically under the safety line during movement of the traveller along the safety line.

22. A fall arrest system according to claim 6, in which the load member is connected to the unitary rigid body structure for rotational movement relative to the unitary rigid body structure through an arc around the bore.

23. A fall arrest system according to claim 6, in which the load member is connected to the unitary rigid body structure so that when the traveller is supported on the safety line passing through the bore the load member and the unitary rigid body structure can rotate independently about the safety line.

* * * * *